US007427831B2

(12) United States Patent
Ahn

(10) Patent No.: US 7,427,831 B2
(45) Date of Patent: Sep. 23, 2008

(54) ELECTRON EMISSION DEVICE AND ELECTRON EMISSION DISPLAY DEVICE

(75) Inventor: Sang-Hyuck Ahn, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/350,649

(22) Filed: Feb. 8, 2006

(65) Prior Publication Data

US 2006/0220523 A1 Oct. 5, 2006

(30) Foreign Application Priority Data

Mar. 31, 2005 (JP) ..... 10-2005-0026991

(51) Int. Cl.
*H01J 1/62* (2006.01)
*H01J 63/04* (2006.01)
*H01J 1/88* (2006.01)

(52) U.S. Cl. ..... 313/497; 313/293; 313/297

(58) Field of Classification Search ..... 313/495–497, 313/309–311, 293, 296, 297; 315/169.2
See application file for complete search history.

(56) References Cited

U.S. PATENT DOCUMENTS

| | | | | |
|---|---|---|---|---|
| 5,955,850 | A * | 9/1999 | Yamaguchi et al. | 313/495 |
| 6,163,107 | A * | 12/2000 | Itoh et al. | 313/495 |
| 6,218,778 | B1 * | 4/2001 | Tomita et al. | 313/495 |
| 6,674,242 | B2 * | 1/2004 | Kastalsky et al. | 315/169.3 |
| 6,677,706 | B1 * | 1/2004 | Hara et al. | 313/496 |
| 2002/0017857 | A1 * | 2/2002 | Hashimoto et al. | 313/496 |
| 2004/0066132 | A1 * | 4/2004 | Cho et al. | 313/495 |
| 2005/0179380 | A1 * | 8/2005 | Oh et al. | 313/581 |
| 2005/0184649 | A1 * | 8/2005 | Ha | 313/497 |
| 2005/0242704 | A1 * | 11/2005 | Lee et al. | 313/495 |
| 2006/0001359 | A1 * | 1/2006 | Hwang | 313/495 |
| 2006/0087248 | A1 * | 4/2006 | Konishi et al. | 315/169.3 |
| 2006/0145582 | A1 * | 7/2006 | Huber | 313/309 |

FOREIGN PATENT DOCUMENTS

JP 9-11534 1/1997

(Continued)

OTHER PUBLICATIONS

Patent Abstracts of Japan, Publication No. 09-011534, dated Jan. 14, 1997, in the name of Yoichi Kobori et al.

(Continued)

*Primary Examiner*—Peter Macchiarolo
(74) *Attorney, Agent, or Firm*—Christie, Parker & Hale, LLP

(57) ABSTRACT

An electron emission device includes an electron emission region formed on a substrate for emitting electrons, a driving electrode for controlling the emission of the electrons, and a focusing electrode electrically insulated from the driving electrode. The driving electrode has an effective portion for inducing the emission of the electrons from the electron emission region, and a first voltage applying portion electrically connected to the effective portion. The focusing electrode has a focusing portion for focusing the electrons emitted from the electron emission region, and a second voltage applying portion electrically connected to the focusing portion. The effective portion and the focusing portion are disposed in different planes from each other, and the first applying portion and the second voltage applying portion are non-overlapping.

18 Claims, 4 Drawing Sheets

FOREIGN PATENT DOCUMENTS

| | | |
|---|---|---|
| JP | 9-11537 | 1/1997 |
| JP | 9-63461 | 3/1997 |
| JP | 11-111156 | 4/1999 |
| JP | 2000-215793 | 8/2000 |
| JP | 2001-229805 | 8/2001 |

OTHER PUBLICATIONS

Patent Abstracts of Japan, Publication No. 09-011537, dated Jan. 14, 1997, in the name of Yoichi Kobori et al.

Patent Abstracts of Japan, Publication No. 09-063461, dated Mar. 7, 1997, in the name of Masaru Sugimoto et al.

Patent Abstracts of Japan, Publication No. 11-111156, dated Apr. 23, 1999, in the name of Masaharu Tomita et al.

Patent Abstracts of Japan, Publication No. 2000-215793, dated Aug. 4, 2000, in the name of Hiroshi Oki et al.

Patent Abstracts of Japan, Publication No. 2001-229805, dated Aug. 24, 2001, in the name of Mitsuru Tanaka et al.

* cited by examiner

ELECTRON EMISSION DEVICE AND ELECTRON EMISSION DISPLAY DEVICE

CROSS-REFERENCE TO RELATED APPLICATION

This application claims priority to and the benefit of Korean Patent Application 10-2005-0026991 filed in the Korean Intellectual Property Office on Mar. 31, 2005, the entire content of which is incorporated herein by reference.

BACKGROUND OF THE INVENTION

1. Field of the Invention

The present invention relates to an electron emission device and an electron emission display device with the electron emission device, and in particular, to an electron emission device which reduces the capacitance of a parasitic capacitor, and an electron emission display device with the electron emission device.

2. Description of Related Art

Generally, an electron emission device has an electron emission source for emitting electrons under the application of a predetermined driving signal so that it may be applied for use in various devices operated with the emitted electrons. For instance, an electron emission display device uses the electron emission device to display the desired screen image.

Electron emission devices are classified into a first type, in which a hot cathode is used as the electron emission source, and a second type, in which a cold cathode is used as the electron emission source.

Among the second type electron emission devices are known a field emitter array (FEA) type, a surface conduction emission (SCE) type, a metal-insulator-metal (MIM) type, and a metal-insulator-semiconductor (MIS) type.

Such an electron emission device may be provided with a driving electrode controlling the emission of electrons from the electron emission source, and a focusing electrode for focusing the electrons emitted from the electron emission source.

A parasitic capacitor with a relatively high capacitance may be formed at the overlapped area of the focusing electrode and the driving electrode, which are spaced apart from each other by a distance. The parasitic capacitor may induce a delay of the driving signal applied to the driving electrode, or other signal distortions.

When such an electron emission device having a parasitic capacitor with a relatively high capacitance is applied for use in constructing the electron emission display device, the display quality of the electron emission display device may therefore be deteriorated due to the signal distortion.

SUMMARY OF THE INVENTION

Various embodiments of the invention provide an electron emission device which lowers the capacitance of a parasitic capacitor between the driving and the focusing electrodes to thereby prevent signal delay, and an electron emission display device with the electron emission device to display the desired screen image with improved quality.

According to one aspect of the present invention, an electron emission device includes an electron emission region formed on a substrate for emitting electrons, a driving electrode for controlling the emission of the electrons, and a focusing electrode electrically insulated from the driving electrode. The driving electrode has an effective portion for inducing emission of electrons from the electron emission region, and a first voltage application portion electrically connected to the effective portion. The focusing electrode has a focusing portion for focusing the electrons emitted from the electron emission region, and a second voltage application portion electrically connected to the focusing portion. The effective portion and the focusing portion are disposed in different planes from each other, and the first application portion and the second voltage application portion are non-overlapping.

The effective portion and the first voltage application portion are in different planes from each other, and the first voltage application portion and the second voltage application portion are disposed in a same plane while being spaced apart from each other by a distance. Alternatively, the effective portion and the first voltage application portion may be disposed in a same plane, and the focusing portion and the second voltage application portion may be disposed in a different plane from the effective portion and the first voltage application portion.

The first and the second voltage application portions, in one embodiment, are disposed opposite to each other, and the electron emission region is disposed between them.

In one embodiment, the effective portion has a plurality of effective portion segments separately formed corresponding to unit pixel regions defined on the substrate, and the first voltage application portion is electrically connected to the plurality of effective portion segments. The focusing portion has a plurality of focusing portion segments separately formed corresponding to the unit pixel regions, and the second voltage application portion is electrically connected to the plurality of focusing portion segments. The plurality of effective portion segments are each formed corresponding to respective ones of the plurality of focusing portion segments.

According to another aspect of the present invention, an electron emission display device includes a phosphor layer and an anode electrode together with the electron emission device.

With the electron emission device according to these embodiments, the electrode shape is improved such that the overlapped area of the electrodes can be minimized or reduced, and accordingly, the capacitance of the inter-electrodes parasitic capacitor can be lowered. With the electron emission display device having the electron emission device according to the present invention, the signal delay is minimized or reduced, and the screen image quality is enhanced.

BRIEF DESCRIPTION OF THE DRAWINGS

The above and other aspects of the present invention will become more apparent by describing examples of embodiments thereof in detail with reference to the accompanying drawings in which.

DETAILED DESCRIPTION

The present invention will be described more fully hereinafter with reference to the accompanying drawings, in which examples of embodiments of the invention are shown.

Figure 1:
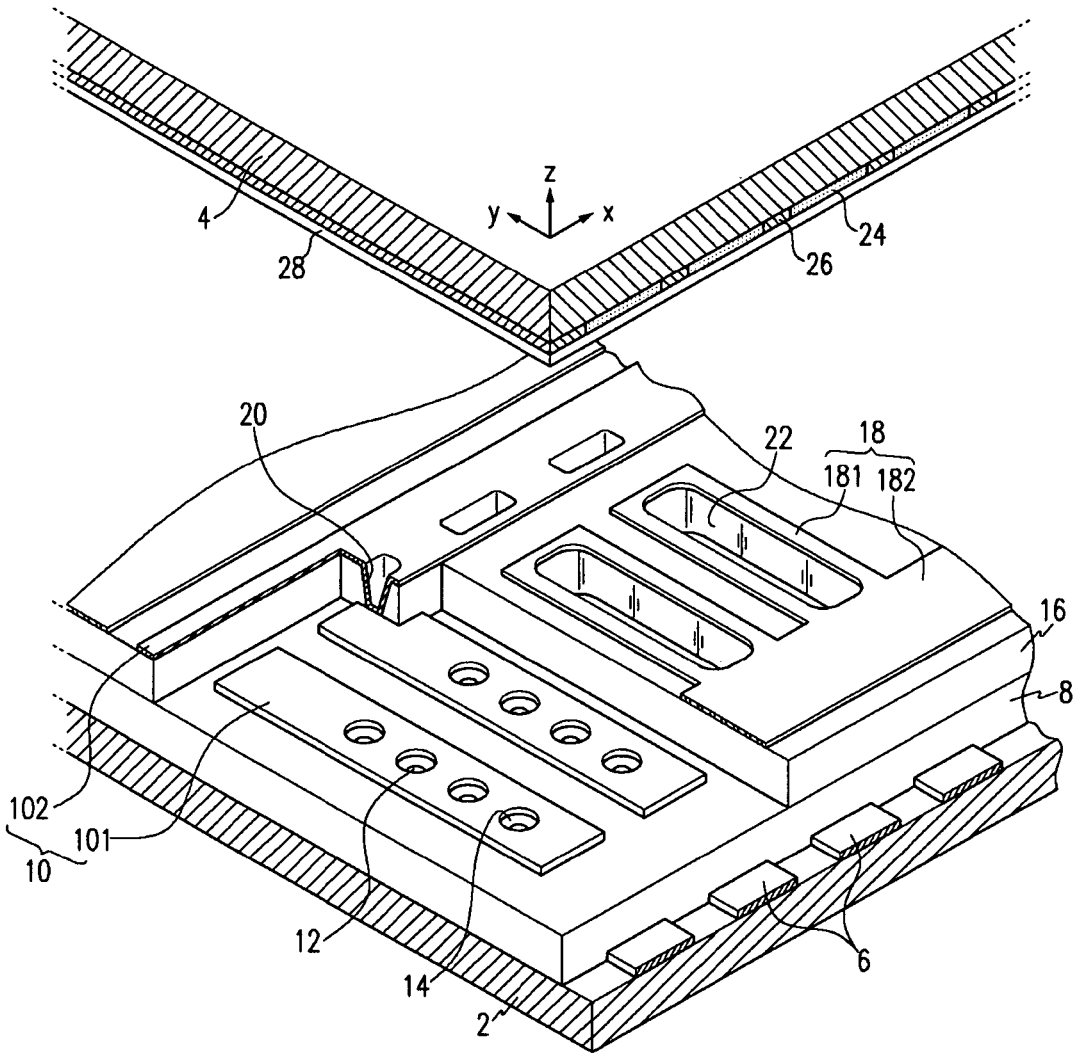
FIG. 1 is a partial exploded perspective view of an electron emission display device according to an embodiment of the present invention.
Figure 2:
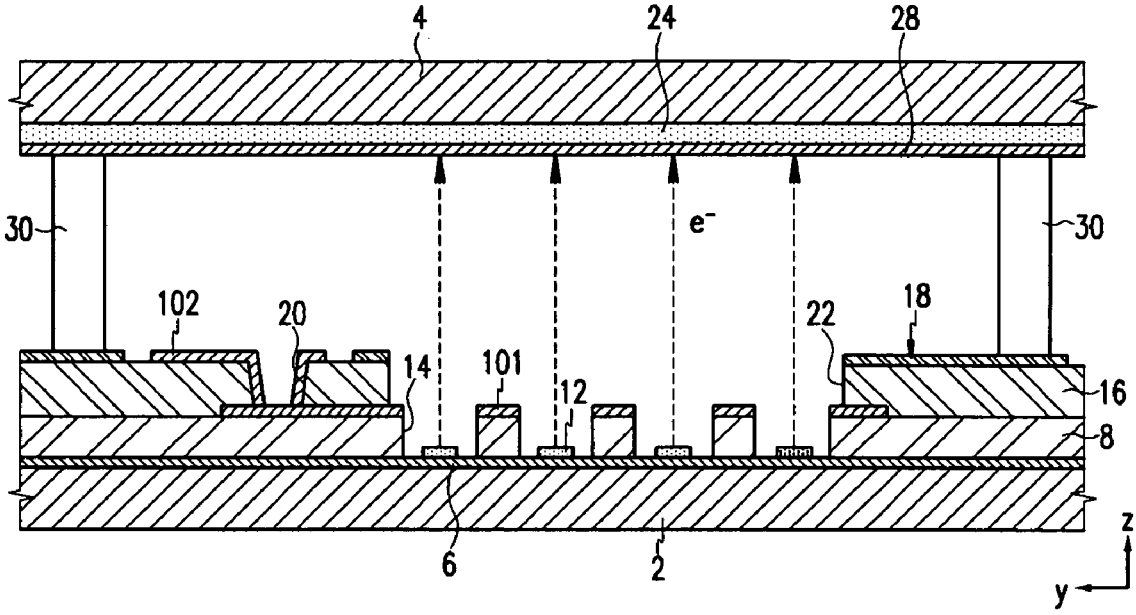
FIG. 2 is a partial sectional view of the electron emission display device shown in FIG. 1.
Figure 3:
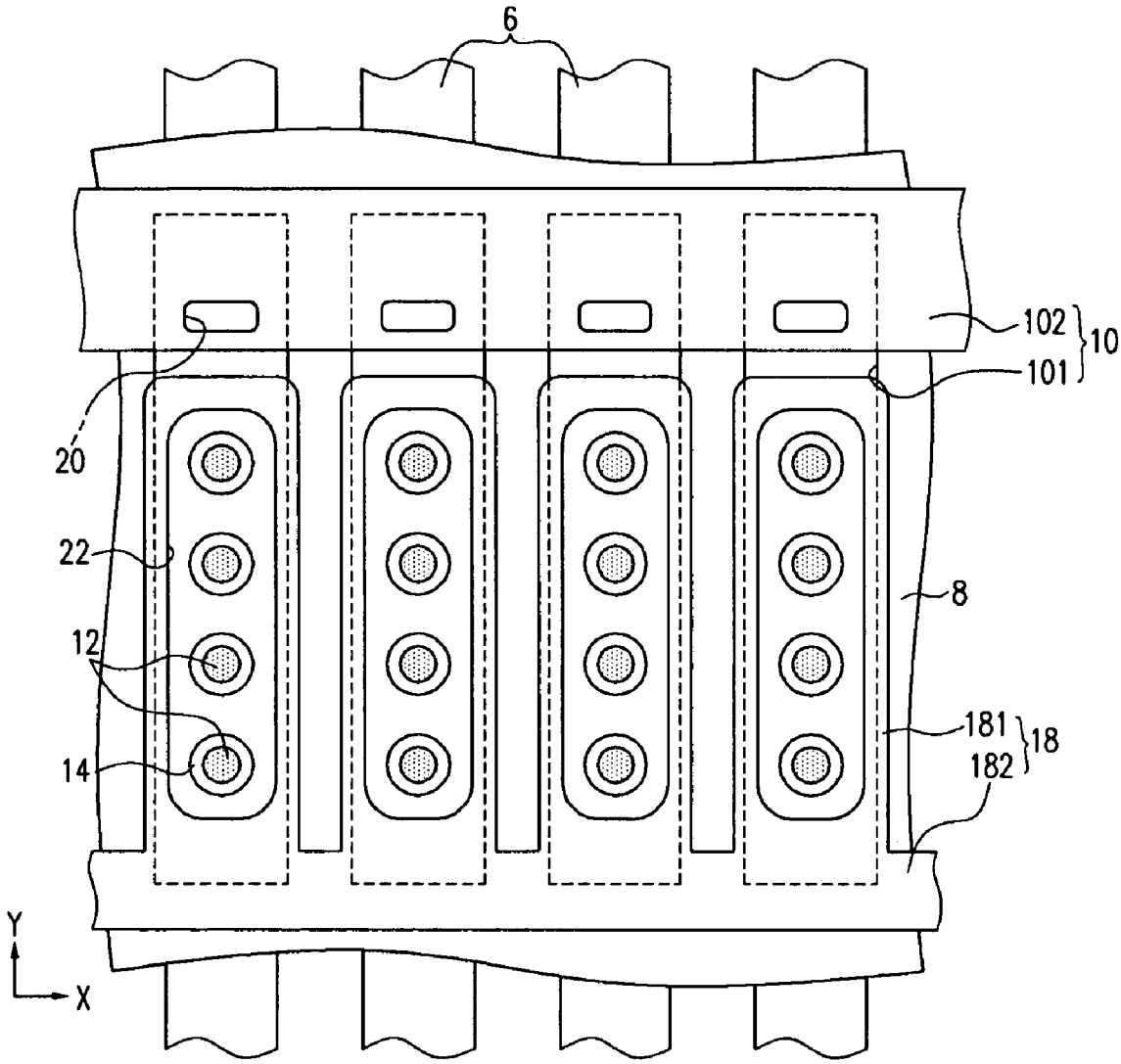
FIG. 3 is a partial plan view of the electron emission display device shown in FIG. 1.

FIG. 1 is a partial exploded perspective view of an electron emission display device according to an embodiment of the present invention, and FIG. 2 is a partial sectional view of the electron emission display device shown in FIG. 1. FIG. 3 is a partial plan view of the electron emission display device shown in FIG. 1.

As shown in FIGS. 1-3, the electron emission display device according to one embodiment of the present invention includes first and second substrates 2 and 4 arranged parallel to each other and separated by a predetermined distance. An electron emission structure is provided at the first substrate 2, and a light emission structure is provided at the second substrate 4 to emit visible rays due to the electrons, for light emission or display.

Cathode electrodes 6 are oriented on the first substrate 2 along the direction of the y axis in FIG. 1, and a first insulating layer 8 is formed on the entire surface of the first substrate 2 while covering the cathode electrodes 6.

Effective portions 101 of a gate electrode 10 are separately placed on the first insulating layer 8 at unit pixel (sub-pixel) regions defined on the first substrate 2. In this embodiment, the effective portions 101 of the gate electrode 10 each are located at the respective unit pixel regions. However, the present invention is not limited thereto, and it is also possible that one effective portion is extended over a plurality of unit pixel regions.

One or more electron emission regions 12 are formed on the cathode electrodes 6 per the respective unit pixel regions, and opening portions 14 are formed at the first insulating layer 8 and the effective portions 101 of the gate electrode 10 corresponding to the respective electron emission regions 12 while exposing the electron emission regions 12.

The electron emission regions 12 are formed with a material emitting electrons under the application of an electric field, such as a carbonaceous material or a nanometer (nm) sized material. The electron emission regions 12 are formed with carbon nanotube, graphite, graphite nanofiber, diamond, diamond-like carbon, $C_{60}$, silicon nanowire or a combination thereof, by way of screen-printing, direct growth, chemical vapor deposition, or sputtering.

It is illustrated in the drawing that the electron emission regions 12 are formed in the shape of a circle, and linearly arranged along the length of the cathode electrodes 6 at the respective unit pixel regions. However, the plane shape and the number per unit pixel and arrangement of the electron emission regions 12 are not limited to the illustrated, but may be altered in various ways.

A second insulating layer 16 is formed on the first insulating layer 8 covering the effective portions 101 of the gate electrode 10, and a first voltage applying portion 102 of the gate electrode 10 and a focusing electrode 18 are formed on the second insulating layer 16.

The first voltage applying portion 102 is formed along a peripheral side of the effective portions 101 perpendicular to the cathode electrodes 6 (along the direction of the x axis of the drawing). The first voltage applying portion 102 is electrically connected to the effective portions 101 to apply driving voltages thereto. For this purpose, the effective portions 101 and the voltage applying portion 102 are electrically connected to each other through via holes 20 formed at the second insulating layer 16 per the overlapped regions thereof.

The focusing electrode 18 has focusing portions 181 provided at the respective unit pixels defined on the first substrate 2 to focus the electrons emitted from the electron emission regions 12, and a second voltage applying portion 182 formed along peripheral sides of the focusing portions 181 perpendicular to the cathode electrodes 6 while being connected to the focusing portions 181. In this embodiment, the focusing portions 181 of the focusing electrode 18 are separately formed at the respective unit pixel regions. However, the present invention is not limited thereto, but it is also possible that one focusing portion is extended over a plurality of unit pixel regions.

Opening portions 22 are formed at the second insulating layer 16 and the focusing portions 181 to allow the electron beams to pass. For instance, the opening portions 22 are provided at the respective unit pixels one by one to collectively focus the electrons emitted at each unit pixel.

The first voltage applying portion 102 of the gate electrode 10 and the second voltage applying portion 182 of the focusing electrode 18 proceed parallel to each other while interposing the electron emission regions 12 between them. That is, the first voltage applying portion 102 of the gate electrode 10 is placed at one peripheral side of the unit pixel arrays located in the direction of the x axis of the drawing, and the second voltage applying portion 182 of the focusing electrode 18 is placed at the opposite peripheral side thereof. In this way, the focusing portions 181 and the second voltage applying portion 182 of the focusing electrode 18 are spaced apart from the voltage applying portion 102 of the gate electrode 10 on the second insulating layer 16, thereby avoiding electrical shorts.

In this embodiment, the effective portions 101 of the gate electrode 10 are overlapped with the focusing portions 181 of the focusing electrode 18 while extending in different planes. By contrast, the first voltage applying portion 102 of the gate electrode 10 and the second voltage applying portion 182 of the focusing electrode 18 extend in the same plane, but are displaced from each other such that they do not overlap.

In this embodiment, the effective portions 101, primarily responsible for inducing electrons to emit, and the focusing portions 181, primarily responsible for focusing the electrons, overlap. By contrast, the first and the second voltage applying portions 102 and 182, which only slightly serve to emit or focus the electrons, do not overlap. In this way, the overlapped area of the gate and the focusing electrodes 10 and 18 is minimized or reduced. In this embodiment, with the minimizing or reduction of the overlapped area of the gate and the focusing electrodes 10 and 18, the capacitance of a parasitic capacitor can be effectively reduced.

Red, green and blue phosphor layers 24 are formed on a surface of the second substrate 4 facing the first substrate 2 while being spaced apart from each other by a distance, and black layers 26 are disposed between the respective phosphor layers 24 to improve the screen contrast.

An anode electrode 28 is formed on the phosphor layers 24 and the black layers 26 with a metallic material, such as aluminum Al. The anode electrode 28 receives the voltage required for accelerating the electron beams from the outside, and reflects the visible rays radiated from the phosphor layers 24 to the first substrate 2 toward the second substrate 4, thereby heightening the screen luminance.

The anode electrode may be formed with a transparent conductive layer such as indium tin oxide (ITO) instead of the metallic layer. In this case, the anode electrode is placed on a surface of the phosphor layers and the black layers directed toward the second substrate. The anode electrode may be patterned with a plurality of separate portions.

Spacers 30 are arranged between the first and the second substrates 2 and 4, and the first and the second substrates 2 and 4 are sealed to each other at their peripheries using a sealant, such as a glass frit. The inner space between the first and the second substrates 2 and 4 is exhausted to be in a vacuum state, thereby constructing an electron emission display device. The spacers 30 are located corresponding to the non-light emission regions where the black layers 26 are located.

The above-structured electron emission display device is operated by applying predetermined voltages to the cathode electrodes 6, the gate electrode 10, the focusing electrode 18 and the anode electrode 28 from the outside. For instance, a scanning signal voltage is applied to any one of the cathode and the gate electrodes 6 and 10, and a data signal voltage to the other electrode. A minus (−) voltage of several to several tens of volts is applied to the focusing electrode 18, and a plus (+) voltage of several hundreds to several thousands of volts to the anode electrode 28.

Accordingly, electric fields are formed around the electron emission regions 12 at the unit pixels where the voltage difference between the cathode and the gate electrodes 6 and 10 exceeds the threshold voltage, and electrons are emitted from the electron emission regions 12. The emitted electrons are focused while passing the focusing electrode 18, and attracted by the high voltage applied to the anode electrode 28, thereby colliding against the phosphor layers 24 and causing them to emit light.

As described above, with the electron emission device according to this embodiment of the present invention, the overlapped area of the gate and the focusing electrodes 10 and 18 is reduced so that the capacitance of the parasitic capacitor between the gate and the focusing electrodes 10 and 18 can be effectively lowered. Accordingly, with the electron emission display device according to this embodiment of the present invention, signal delay is reduced or prevented, and therefore, the screen image quality can be improved.

In this embodiment, the electron emission regions and the driving electrodes formed on the first substrate form an electron emission device for emitting electrons, and the electron emission device is applied for use in constructing an electron emission display device. However, the electron emission device according to the present embodiment may be applied for use in manufacturing various devices.

Figure 4:
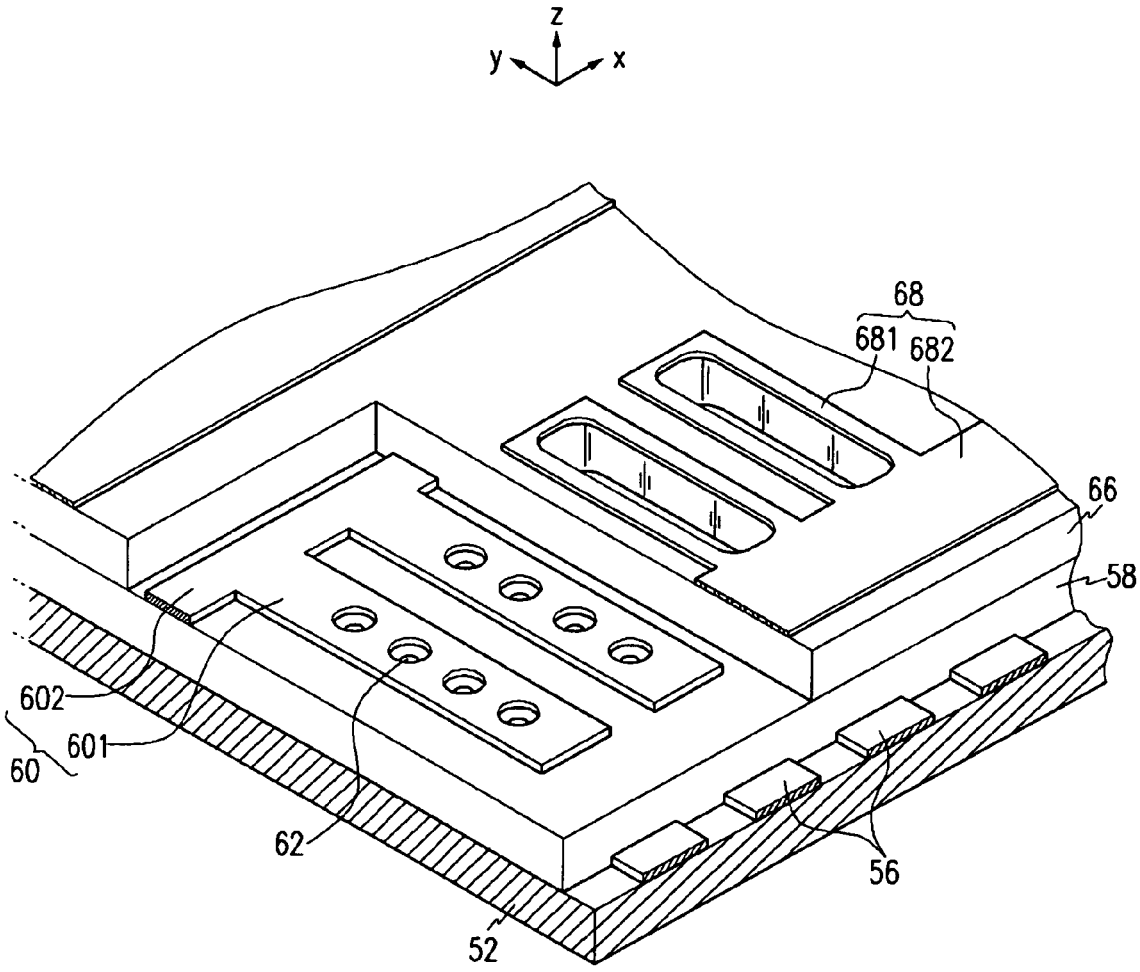
FIG. 4 is a partial perspective view of an electron emission device according to another embodiment of the present invention.

FIG. 4 is a partial perspective view of an electron emission device according to another embodiment of the present invention.

As shown in FIG. 4, with the electron emission device according to the present embodiment, cathode electrodes 56 are formed on a first substrate 52, and a first insulating layer 58 is formed on the first substrate 52 while covering the cathode electrodes 56. Effective portions 601 of a gate electrode 60 and a first voltage applying portion 602 of the gate electrode 60 are formed on the first insulating layer 58. In this embodiment, the effective portions 601 are separately provided at the respective unit pixels, and the first voltage applying portion 602 is oriented along the direction of the x axis of the drawing. The gate electrode 60 is formed in the shape of a comb, but the present invention is not limited to that shape.

A second insulating layer 66 covers the gate electrodes 60, and focusing portions 681 and second voltage applying portions 682 of a focusing electrode 68 are formed on the second insulating layer 66. In this embodiment, the focusing portions 681 are separately provided at the respective unit pixels, and the second voltage applying portions 682 are oriented in the direction of the x axis of the drawing. That is, the focusing electrode 68 is formed in the shape of a comb, but the present invention is not limited to that shape.

When viewed from the plan side, the first voltage applying portion 602 of the gate electrode 60 and the second voltage applying portion 682 of the focusing electrode 68 are arranged parallel to each other with the electron emission regions 62 interposed between them. Thus, the first voltage applying portion 602 and the second voltage applying portion 682 do not overlap with each other. Accordingly, the overlapped area of the gate and the focusing electrodes 60 and 68 can be minimized or reduced. In this embodiment, the effective portions 601 and the first voltage applying portion 602 of the gate electrode 60 are placed at the same plane so that the gate electrode 60 can be formed in a simplified manner.

With the structures according to the previous embodiments, the gate electrode has effective portions and a first voltage applying portion. However, the present invention is not limited thereto, but may be altered provided that any one of the driving electrodes for controlling the emission of electrons from the electron emission regions has the effective portion and the first voltage applying portion.

Various structures may be applied for use in relation to the present invention to minimize the overlap of the portions of the driving electrodes and the focusing electrodes that do not contribute greatly to the emission or focusing of the electrons or focus.

Although examples of embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims and their equivalents.

What is claimed is:

1. An electron emission device comprising:

a cathode electrode on a substrate;

an electron emission region on the cathode electrode and for emitting electrons;

a driving electrode for controlling the emission of the electrons from the electron emission region, the driving electrode comprising an effective portion for inducing the emission of the electrons and a first voltage applying portion spaced from the effective portion to be on a different plane and conductively connected to the effective portion; and a focusing electrode electrically insulated from the driving electrode, the focusing electrode comprising a focusing portion for focusing the electrons emitted from the electron emission region and a second voltage applying portion conductively connected to the focusing portion, wherein the effective portion and the focusing portion are in different planes from each other, and the first voltage applying portion and the second voltage applying portion are non-overlapping.

2. The electron emission device of claim 1, wherein the effective portion and the first voltage applying portion are in different planes from each other, and the first voltage applying portion and the second voltage applying portion are in a same plane as each other and are spaced apart from each other.

3. The electron emission device of claim 2, further comprising an insulating layer substantially covering the effective portion, wherein the first voltage applying portion is on the insulating layer such that the first voltage applying portion is electrically connected to the effective portion through a via hole in the insulating layer.

4. The electron emission device of claim 3, wherein the first voltage applying portion and the effective portion overlap each other at an overlapped region, and wherein the via hole in the insulating layer corresponds to a location of the overlapped region.

5. The electron emission device of claim 3, wherein the first voltage applying portion, the focusing portion and the second voltage applying portion are on the insulating layer.

6. The electron emission device of claim 2, wherein the first voltage applying portion and the second voltage applying portion are opposite to each other and the electron emission region is between the first voltage applying portion and the second voltage applying portion.

7. The electron emission device of claim 6, wherein the first voltage applying portion and the second voltage applying portion are parallel to each other.

8. The electron emission device of claim 1, wherein the first voltage applying portion and the second voltage applying portion are opposite to each other and the electron emission region is between the first voltage applying portion and the second voltage applying portion.

9. The electron emission device of claim 8, wherein the first voltage applying portion and the second voltage applying portion are parallel to each other.

10. The electron emission device of claim 1, wherein the driving electrode has a shape of a comb.

11. The electron emission device of claim 1, further comprising unit pixel regions defined on the substrate, wherein the effective portion comprises a plurality of effective portion segments corresponding to the unit pixel regions, and the first voltage applying portion is electrically connected to the plurality of effective portion segments, and wherein the focusing portion comprises a plurality of focusing portion segments corresponding to the unit pixel regions, and the second voltage applying portion is electrically connected to the plurality of focusing portion segments, the plurality of effective portion segments each corresponding to respective ones of the plurality of focusing portion segments.

12. The electron emission device of claim 1, wherein the driving electrode is formed over the cathode electrode with an insulating layer interposed therebetween.

13. The electron emission device of claim 12, wherein the electron emission region is on the cathode electrode at a unit pixel region on the substrate, and an opening is at the effective portion of the driving electrode corresponding to the electron emission region.

14. The electron emission device of claim 1, wherein the electron emission region is formed with at least one material selected from the group consisting of carbon nanotube, graphite, graphite nanofiber, diamond, diamond-like carbon, $C_{60}$, and silicon nanowire.

15. An electron emission display device comprising:

a first substrate;

a second substrate facing the first substrate;

a cathode electrode on the first substrate;

an electron emission region on the cathode electrode and for emitting electrons;

a driving electrode for controlling the emission of the electrons from the electron emission region, the driving electrode comprising an effective portion for inducing the emission of the electrons from the electron emission region, and a first voltage applying portion spaced from the effective portion to be on a different plane and conductively connected to the effective portion;

a focusing electrode electrically insulated from the driving electrode, the focusing electrode comprising a focusing portion for focusing the electrons emitted from the electron emission region and a second voltage applying portion conductively connected to the focusing portion;

a phosphor layer on the second substrate; and an anode electrode on a surface of the phosphor layer, wherein the effective portion and the focusing portions are in different planes from each other, and the first voltage applying portion and the second voltage applying portion are non-overlapping.

16. The electron emission display device of claim 15, wherein the effective portion and the first voltage applying portion are in different planes from each other, and the first and the second voltage applying portions are in a same plane and are spaced apart from each other.

17. The electron emission display device of claim 15, further comprising unit pixel regions on the first substrate, wherein the effective portion comprises a plurality of effective portion segments corresponding to the unit pixel regions, and the first voltage applying portion is electrically connected to the plurality of effective portion segments, and wherein the focusing portion comprises a plurality of focusing portion segments corresponding to the unit pixel regions, and the second voltage applying portion is electrically connected to the plurality of focusing portion segments, the plurality of effective portion segments each corresponding to respective ones of the plurality of focusing portion segments.

18. The electron emission display device of claim 15, wherein the first voltage applying portion and the second voltage applying portion are opposite to each other and the electron emission region is between the first voltage applying portion and the second voltage applying portion.

* * * * *